United States Patent [19]

Fetters

[11] Patent Number: 4,819,285

[45] **Date of Patent: * Apr. 11, 1989**

[54] PORTABLE COLLAPSIBLE BABY CRIB

[75] Inventor: G. David Fetters, West Lafayette, Ind.

[73] Assignee: Indwell Products Corporation, West Lafayette, Ind.

[ * ] Notice: The portion of the term of this patent subsequent to Sep. 15, 2004 has been disclaimed.

[21] Appl. No.: 56,416

[22] Filed: Jun. 1, 1987

Related U.S. Application Data

[63] Continuation-in-part of Ser. No. 884,487, Jul. 11, 1986, Pat. No. 4,692,953.

[51] Int. Cl.[4] ..... A47C 29/00

[52] U.S. Cl. ..... 5/99 R; 5/99 A

[58] Field of Search ..... 5/93 R, 94, 98 R, 99 R, 5/99 A, 99 B, 99 C, 111, 110; 403/53, 54

[56] References Cited

U.S. PATENT DOCUMENTS

| | | | |
|---|---|---|---|
| 2,659,903 | 11/1953 | Hagelfeldt | 5/93 R |
| 2,691,177 | 10/1954 | Leonard . | |
| 2,846,699 | 8/1958 | Watson . | |
| 3,018,493 | 1/1962 | Wittbrodt . | |
| 3,025,536 | 3/1962 | De Gray . | |
| 3,049,727 | 8/1962 | Ruddy . | |
| 3,049,728 | 8/1962 | Lund . | |
| 3,094,714 | 6/1963 | Lutes . | |
| 3,127,620 | 4/1964 | Peterson . | |
| 3,296,633 | 1/1967 | Rieger . | |
| 3,336,608 | 8/1967 | Lerner . | |
| 3,512,188 | 5/1970 | Salamandyk et al. . | |
| 3,605,139 | 9/1971 | Lorentz, Jr. . | |
| 3,606,620 | 9/1971 | Glover . | |
| 3,631,548 | 1/1972 | Dahab . | |
| 3,654,645 | 4/1972 | Lee . | |
| 3,680,155 | 8/1972 | McMann . | |
| 3,699,594 | 10/1972 | Matthey-Doret . | |
| 3,789,439 | 2/1974 | Berg et al. . | |
| 3,800,341 | 4/1974 | Davanzo . | |
| 3,896,513 | 6/1975 | Boucher et al. . | |
| 4,008,499 | 2/1977 | Wren, Jr. et al. . | |
| 4,044,411 | 8/1977 | Peterson . | |
| 4,070,716 | 1/1978 | Satt et al. . | |
| 4,124,909 | 11/1078 | Saeedy . | |
| 4,133,063 | 1/1979 | Jones-Steele . | |
| 4,143,434 | 3/1979 | Monot . | |
| 4,214,325 | 7/1980 | Camacho . | |
| 4,250,580 | 2/1981 | Eichenauer . | |
| 4,304,017 | 12/1981 | Mortimer . | |
| 4,455,697 | 6/1984 | Rovida . | |
| 4,499,619 | 2/1985 | Kassai . | |
| 4,688,280 | 8/1987 | Kohus et al. | 5/99 R |
| 4,692,953 | 9/1987 | Fetters | 5/99 R |

FOREIGN PATENT DOCUMENTS

| | | | |
|---|---|---|---|
| 1247111 | 10/1960 | France | 5/99 R |

OTHER PUBLICATIONS

"Proving Purpose," *Juvenile Merchandising,* Apr. 1986.

*Primary Examiner*—Alexander Grosz
*Assistant Examiner*—Michael F. Trettel
*Attorney, Agent, or Firm*—Woodard, Emhardt, Nauthton, Moriarty & McNett

[57] ABSTRACT

A portable collapsible crib, comprising a rigid frame that is separable at the midpoints of a pair of opposing sides into a first and second frame half. A rotatable hinge coupling each said frame half at said midpoints pivotal about first axes for collapsing the frame halves one upon the other at the midpoints, and rotatable about second axes that are perpendicular to the first axes for rigidly supporting the frame halves in inflexible planar alignment. Legs, mounted to and rotatable with the rotatable hinge elevate the frame to a predetermined height when disposed downwardly from the frame, the rotatable hinge being concurrently rotated into the frame inflexible position, the legs being further rotatable into parallel planar alignment while the frame, with the rotatable hinge is rotated into the frame collapsing position. A collapsible crib element is mounted to the perimeter of the frame and is disposed downwardly therefrom, having a rigid floor removably attached to the legs at predetermined points below the solid frame when the legs are rotated downwardly from the frame and operable to receive the solid frame and the legs and the collapsible crib structure within the area bounded by the perimeter of the floor when the legs are rotated about the frame into the area bounded by the frame, the rotatable hinge being concurrently rotated into the frame collapsing position. The rigid floor can be folded about to enclose the frame halves when in the frame collapsing position, forming a valise structure.

16 Claims, 5 Drawing Sheets

PORTABLE COLLAPSIBLE BABY CRIB

REFERENCE TO RELATED APPLICATIONS

This is a continuation-in-part of patent application Ser. No. 884,487, filed July 11, 1986 now Pat. No. 4,692,953.

BACKGROUND OF THE INVENTION

Many patents have issued that disclose baby cribs with various mechanisms to provide parents the convenience of crib mobility. Disclosed herein is a novel portable collapsible baby crib that utilizes a more useful and efficient collapsible support structure to support a collapsible crib structure than has heretofore been known in the prior art. The disclosed invention permits the parent to collapse the baby's crib into a compact valise structure that is readily portable when the parents need to travel with their infant.

SUMMARY OF THE INVENTION

One embodiment of the present invention is a portable collapsible crib, comprising a rigid frame that is separable at the midpoints of a pair of opposing sides thereof into a first frame half and a second frame half, rotatable hinging means, coupling the first and second frame halves at said midpoints, hingingly operable about first axes for foldably collapsing the first and second frame halves one upon the other at the midpoints, and defining a frame collapsing position, and rotatably operable about a pair of second axes that are perpendicular to the first axes for rigidly supporting the first and second halves in inflexible planar alignment, and defining a frame inflexible position; leg means, mounted to and rotatable about the frame concurrently with the rotatable hinging means, for elevating the frame to a predetermined height when rotated about and disposed downwardly from the frame, the rotatable hinging means being concurrently rotated into the frame inflexible position, the leg means being further rotatable about the frame into the area bounded by the frame, the rotatable hinging means being concurrently rotated into the frame collapsing position; and a collapsible crib element mounted to and supported about the perimeter of the frame and disposed downwardly therefrom, having rigid floor means removably attached to the leg means at predetermined points below the solid frame when the leg means are rotated about and disposed downwardly from the frame and operable to receive the solid frame and the leg means and the collapsible crib structure within the area bounded by the perimeter of the floor means when the leg means are rotated about the frame into the area bounded by the frame, the rotatable hinge means being concurrently rotated into the frame collapsing position; the rigid floor means being further operable to fold about and enclose the first and second frame halves when in the frame collapsing position, forming a valise structure thereabout.

Another embodiment of the present invention is a portable collapsible frame for supporting a collapsible crib structure, comprising a rigid frame that is separable at the midpoints of a pair of opposing sides thereof into a first frame half and a second frame half; rotatable hinging means, coupling the first and second frame halves at the midpoints, hingingly operable about first axes for foldably collapsing the first and second frame halves one upon the other at the midpoints, and defining a frame collapsing position, and rotatably operable about a pair of second axes that are perpendicular to the first axes for rigidly supporting the first and second frame halves in inflexible planar alignment, and defining a frame inflexible position; leg means, mounted to and rotatable about the frame concurrently with the rotatable hinging means, for elevating the frame to a predetermined height when rotated about and disposed downwardly from the frame, the rotatable hinging means being concurrently rotated into the frame inflexible position, the leg means being further rotatable about the frame into the area bounded by the frame, the rotatable hinging means being concurrently rotated into the frame collapsing position.

Another embodiment of the present invention is a portable collapsible crib, comprising a rigid frame that is separable at the midpoints of a pair of opposing sides thereof into a first frame half and a second frame half; rotatable hinging means, coupling the first and second frame halves at said midpoints, hingingly operable about first axes for foldably collapsing the first and second frame halves one upon the other about the midpoints, defining a frame collapsing position, and rotatably operable about second axes that are perpendicular to the first axes for rigidly supporting the first and second frame halves in inflexible planar alignment, defining a frame inflexible position; leg means, mounted to the frame and rotatable concurrently with the rotatable hinging means, for elevating the frame to a predetermined height when rotated downwardly from the frame, the rotatable hinging means being concurrently rotated into the frame inflexible position, the leg means being further rotatable into parallel planar alignment with the first and second frame halves, the rotatable hinging means being concurrently rotated into the frame collapsing position; and a collapsible crib structure mounted to and supported about the perimeter of the frame and disposed downwardly therefrom, having rigid floor means with rigid floor supports removably attachable to the leg means at predetermined points below the rigid frame when the leg means are disposed downwardly from the frame, operable to receive the rigid frame, the leg means, and the collapsible crib structure within the area bounded by the perimeter of the floor means when the leg means are rotated into parallel planar alignment with the first and second frame halves, the rotatable hinge means being concurrently rotated into the frame collapsing position; the rigid floor means being further operable to fold about and enclose the first and second frame halves in the frame collapsing position and the collapsible crib structure, forming a valise structure thereabout.

Another embodiment of the present invention is a portable collapsible frame for supporting a collapsible crib structure, comprising a rigid frame that is separable generally at the midpoints of a pair of opposing sides thereof into a first frame half and a second frame half; rotatable hinging means, coupling the first and second frame halves at the midpoints, hingingly operable about first axes for foldably collapsing the first and second frame halves one upon the other about the midpoints, defining a frame collapsing position, and rotatably operable about second axes that are perpendicular to the first axes for rigidly supporting the first and second frame halves in inflexible planar alignment, defining a frame inflexible position; and leg means, mounted to the frame and rotatable concurrently with the rotatable hinging means, for elevating the frame to a predetermined height when rotated downwardly from the frame, the rotatable hinging means being concurrently rotated into the frame inflexible position, the leg means being further rotatable into planar alignment with the first and second frame halves, the rotatable hinging means being concurrently rotated into the frame collapsing position.

It is an object of the present invention to provide a novel portable collapsible baby crib that utilizes a completely new and a more useful and efficient collapsible support structure than has heretofore been known in the prior art.

It is a further object of the present invention to provide a collapsible baby crib that collapses into a compact valise structure that serves as the elevated floor of the baby crib when the baby crib is in use.

It is a further object of the present invention to provide a portable collapsible crib with novel rotatable hinging means integrally mounted to the baby crib support structure and that rotate with the collapsible legs of the support structure, providing rigid support for the support structure when the legs are in use and providing collapsibility to the support structure when the legs are rotated into a collapsed position.

Related objects and advantages of the present invention will be apparent from the following description.

DESCRIPTION OF THE PREFERRED EMBODIMENTS

Figure 1:
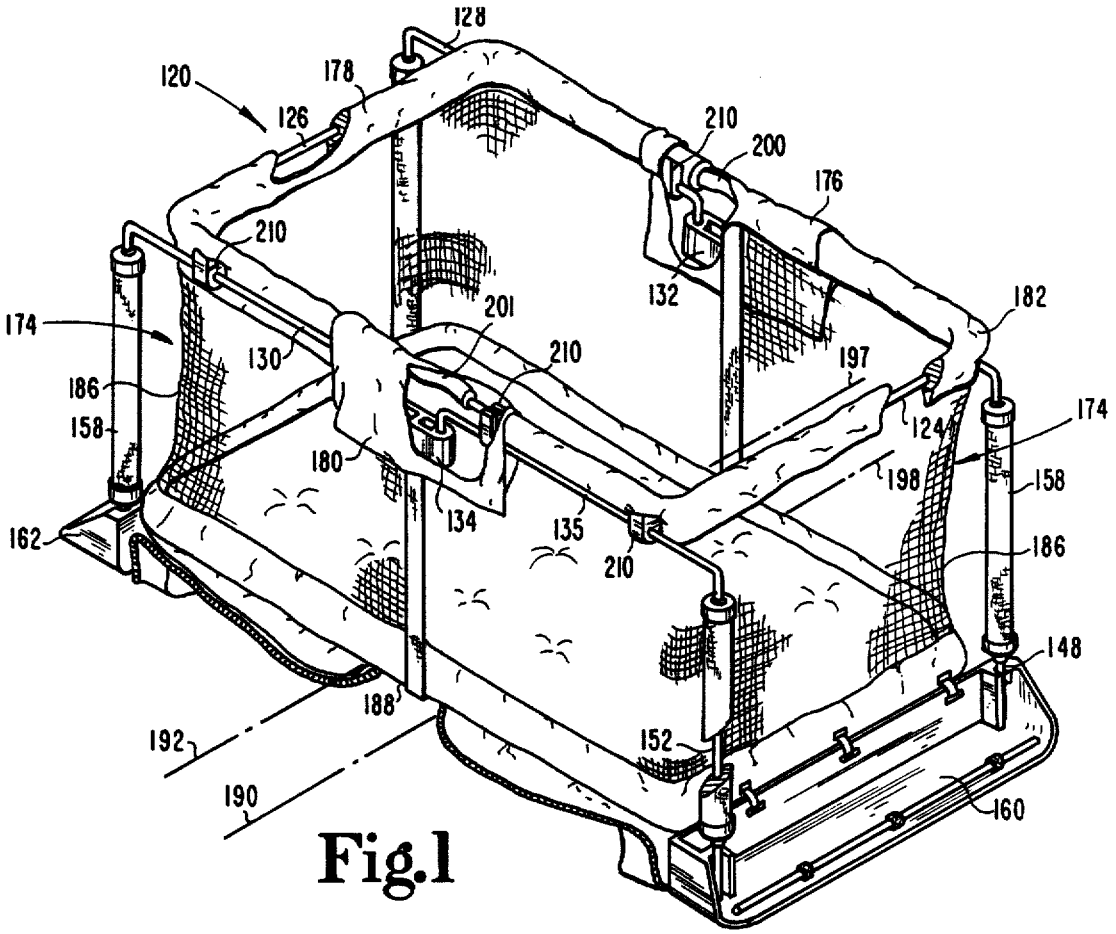
FIG. 1 is a perspective and partially segmented view of the most preferred embodiment of the portable collapsible baby crib of the present invention, uncollapsed and ready for use with the rotatable hinging means of the most preferred embodiment of the invention in the frame inflexible position.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
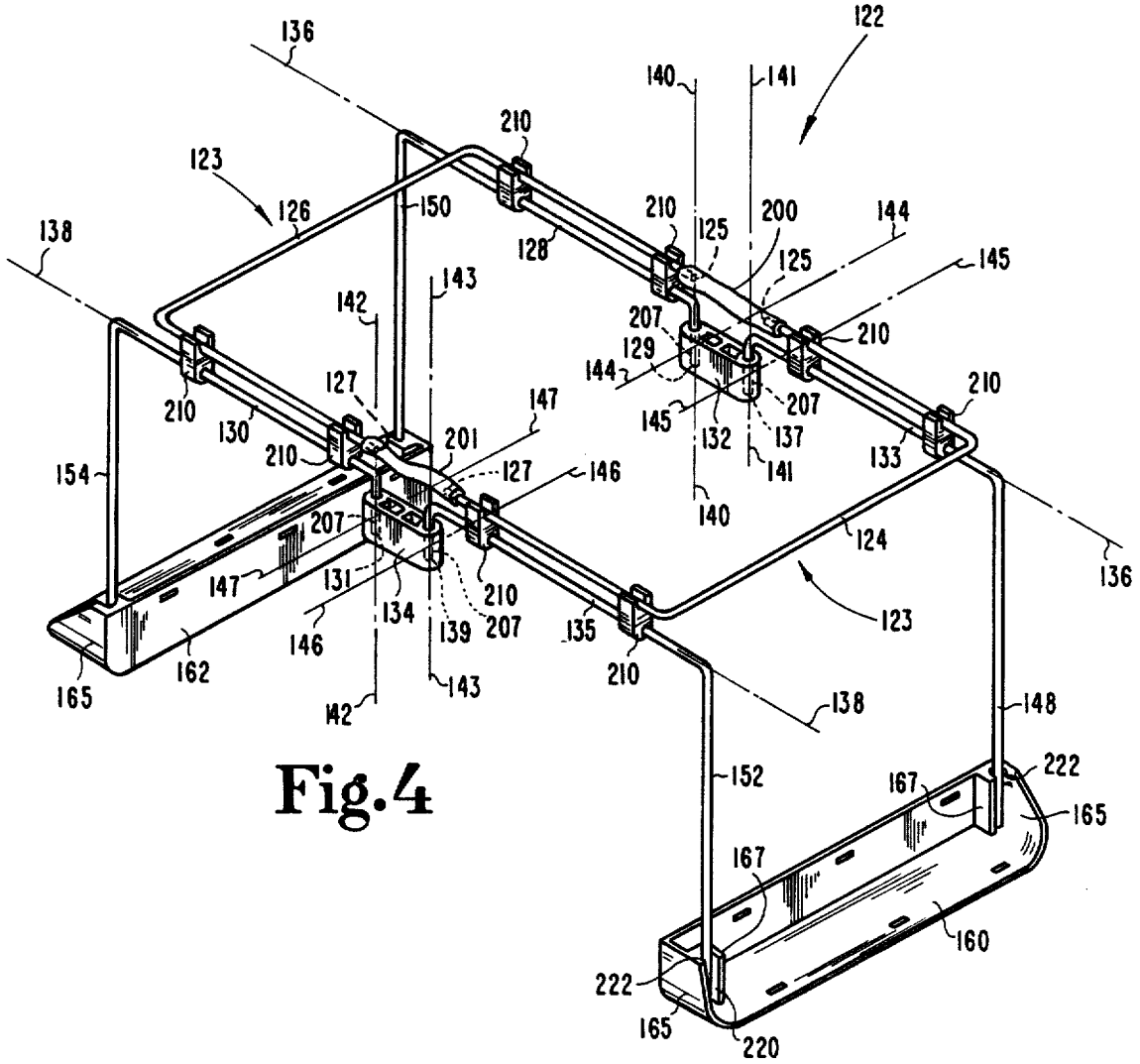
FIG. 4 is a perspective view of the support structure of the portable collapsible baby crib of FIG. 1, shown without the collapsible crib structure of the present invention but with the rigid floor supports of the rigid floor means of the present invention, and uncollapsed and ready for use with the rotatable hinging means of the present invention in the frame inflexible position.

Referring again to the drawings, there is shown in FIG. 1 the most preferred embodiment of the portable collapsible baby crib 120 of the present invention, shown in FIG. 1 uncollapsed and ready for use. Referring to FIGS. 1 and 4, portable collapsible baby crib 120 has an underlying support structure 122, shown in FIG. 4 with the rigid floor supports 160 and 162 of the most preferred embodiment, which will be described below. Support structure 122 includes a rigid frame 123 that is separable at the midpoints 125 and 127 of a pair of opposing sides thereof into a first frame half 124 and a second frame half 126. In the most preferred embodiment, first and second frame halves 124 and 126 are identically sized cylindrical U-tubes, constructed of readily available cylindrical tube stock, which, if midpoints 125 and 127 were placed end-to-end, would form a rectangularly-shaped rigid frame separable at the midpoints 125 and 127 of the pair of longest opposing sides thereof. In the most preferred embodiment, first and second frame halves 124 and 126 are slidably and snugly received at midpoints 125 and 127 into first and second flexible couplings 200 and 201, respectively (FIG. 4), which flexibly couple first and second frame halves 124 and 126 together at midpoints 125 and 127. First and second flexible couplings 200 and 201 of the most preferred embodiment are constructed from readily available conventional flexible tubing.

Figure 7:
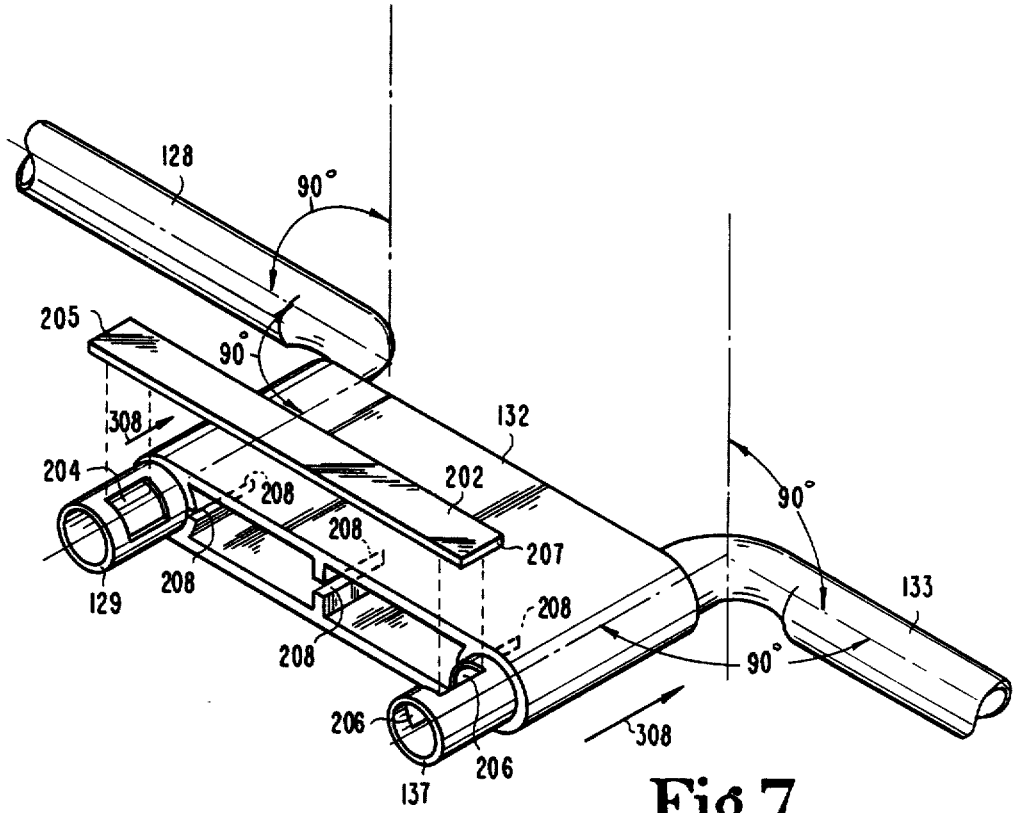
FIG. 7 is an enlarged, segmented, and partially exploded perspective view of the rotatable hinging means 132 of the most preferred embodiment of the present invention in the frame collapsing position.
Figure 8:
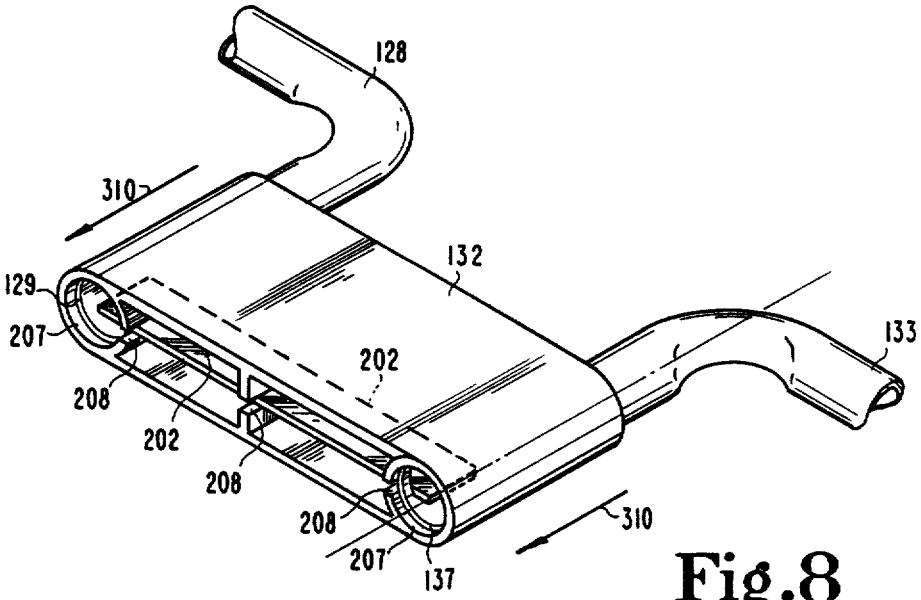
FIG. 8 is an enlarged and segmented perspective view of the rotatable hinging means 132 of FIG. 7 in a fully assembled configuration.

Referring now to FIGS. 4, 7, and 8, the rotatable hinging means of the most preferred embodiment of the present invention includes a rigid first bottom rail tube 128, and a rigid third bottom rail tube 133 hinged at end points 129 and 137 thereof, respectively, by first hinge 132; and a rigid second bottom rail tube 130 and a rigid fourth bottom rail tube 135 hinged at end points 131 and 139 thereof, respectively, by second hinge 134. Bottom rail tubes 128, 133, 130, and 135 each have proximal end portions at end points 129, 137, 131, and 139, respectively, that are bent through 90 degrees (FIGS. 4, 7, and 8). These proximal end portions at end points 129 and 137 of bottom rail tubes 128 and 133, respectively, are slidably received into correspondingly sized cylindrical through channels 207 (FIG. 8) in first hinge 132 (FIGS. 7 and 8), wherein the proximal end portions of bottom rail tubes 128 and 133 remain snugly rotatable. In similar fashion, the proximal end portions at end points 131 and 139 of bottom rail tubes 130 and 135, respectively, are slidably received into correspondingly sized cylindrical through channels in second hinge 134, wherein bottom rail tubes 130 and 135 remain snugly rotatable.

Referring to FIGS. 7, and 8, first hinge 132 is removably attached to the proximal end portions of first and third bottom rail tubes 128 and 133 at end points 129 and 137, respectively, by retaining bar 202. Referring to FIGS. 7 and 8, when first hinge 132 is slidably moved along the proximal end portions of first and third bottom rail tubes 128 and 133 in the direction of arrows 308, retaining bar 202 is received into open quadrants 204 and 206 cut in the proximal end portions of bottom rail tubes 128 and 133 (FIG. 7) such that the first and second end portions 205 and 207, respectively, of retaining bar 202 are disposed along the centerlines of the proximal end portions of bottom rail tubes 128 and 133, respectively. Referring to FIGS. 7 and 8, retaining bar 202 is snugly and fixedly received into correspondingly sized retaining bar channels 208 in first hinge 132, as first hinge 132 is slidably moved along the proximally end portions of first and second bottom rail tubes 128 and 133, respectively, in the direction of arrows 310 (FIG. 8) and toward end points 129 and 137, respectively. When fully received within first hinge 132 as first hinge 132 is moved in the direction of arrows 310 (FIG. 8), retaining bar 202 is operable to limit the rotation of first and third bottom tubes 128 and 133 within the through channels 207 of first hinge 132 to the ninety degrees of open quadrants 204 and 206 cut in the proximal end portions of bottom rail tubes 128 and 133 (FIGS. 7 and 8) to prevent undesirable and uncontrollable over-rotation of such tubes beyond the frame collapsing and frame inflexible positions, as described, and operates the means to limit the rotation of the hinging means of the present invention. Open quadrants 204 and 206 are positioned on the circumferences of the proximal end portions of first and third bottom rail tubes 128 and 133 such that they are rotatable within first hinge 132 only between the frame inflexible position (FIG. 4) and the frame collapsing position (FIG. 5) of the present invention to be discussed below. In a similar and mirror image fashion, the proximal end portions of bottom rail tubes 130 and 135 are received into and are removably attached to second hinge 134, which is of identical construction to first hinge 132. In the most preferred embodiment, first and second hinges can be constructed, or injection molded, from a suitably durable plastic material. Retaining bar 202 can be constructed from any suitably rigid material.

Figure 9:
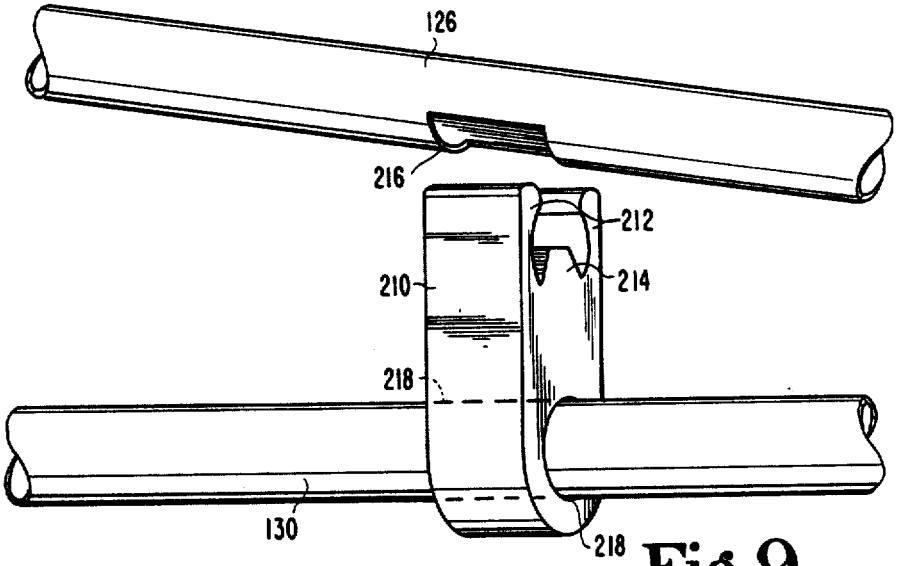
FIG. 9 is an enlarged segmented view of the fasteners 210 of the most preferred embodiment of the present invention.

Referring to FIGS. 4 and 9, in the most preferred embodiment, first bottom rail tube 128 and third bottom rail tube 133, hinged by first hinge 132 at end points 129 and 137 of such bottom rail tubes, respectively, are affixed in parallel relationship immediately below one of said opposing sides of frame 123 such that first bottom rail tube 128 and third bottom rail tube 133 are on opposite sides of midpoints 125 of frame 124, and such that first hinge 132 and said midpoints 125 are in juxtaposition. Similarly, and in mirror-image relationship, second bottom rail tube 130 and fourth bottom rail tube 135 hinged by second hinge 134 at end points 131 and 139 thereof, respectively, affixed in parallel relationship immediately below the other of said opposing sides of frame 123 such that second bottom rail tube 130 and fourth bottom rail tube 135 are on opposite sides of midpoints 127 of frame 123, and such that second hinge 134 and midpoints 127 are in juxtaposition.

Figure 10:
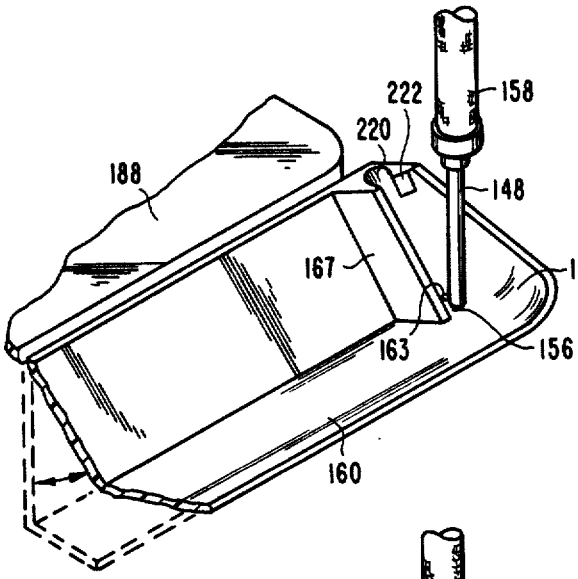
FIG. 10 is an enlarged segmented view of rigid floor means 188 with rigid floor support 160 of FIG. 1 about to receive the distal end of leg 148 of the most preferred embodiment of the present invention into snapping engagement.

Referring now to FIGS. 4, 9, and 10, in the most preferred embodiment, bottom rail tubes 128, 130 (FIG. 9), 133, and 135 are affixed in the above-described relative position with first and second frame halves 124 and 126 of frame 124 by snap-fittings 210. Referring to FIG. 9, snap-fittings 210 have conventional tongs 212 that snappingly receive the tubular first and second frame halves, 124 and 126 (FIG. 9), of the most preferred embodiment. Snap-fittings 210 are held in proper relative position with respect to first and second frame halves 124 and 126 by means of tongue 214 disposed between the tongs 212 of snap-fittings 210, which tongue 214 is received into a correspondingly-sized openings 216 cut or stamped into the bottom-most quadrant of in first and second frame halves 124 and 126 (FIG. 9). Tongue 214 is sized to be snugly received within openings 216 when tongs 212 snappingly receive first and second frame halves 124 and 126 (FIG. 9), thereby preventing snap-fittings 210 from rotating about first and second frame halves 124 and 126. Snap-fittings 210 are also provided with tubular channels 218 to slidably receive tubular bottom rail tubes 128, 130 (FIG. 9), 133, and 135 of the most preferred embodiment of the present invention. Bottom rail tubes 128, 130, 133, and 135 thereby remain rotatable within the tubular channels 218 of snap-fittings 210 when the snap-fittings 210 are rigidly affixed in parallel relationship with first and second frame halves 124 and 126 (FIG. 9). Thus, rotatable bottom rail tubes 128, 130, 133, and 135 are operable to rotate said first and second hinges 132 and 134 about a pair of second axes of rotation that are along lines 136—136 and 138—138, respectively, (FIG. 4), which are the axes of rotation of bottom rail tubes 128 and 133, and 130 and 135, respectively.

As oriented in FIG. 4, first and second hinges 132 and 134 are hingingly operable only about the axes that are along lines 140—140 and 141—141, and 142—142 and 143—143, respectively. When first and third bottom rail tubes 127 and 133, and second and fourth bottom rail tubes 130 and 135, are affixed in parallel relationship with first and second frame halves 124 and 126 with snap-fittings 210 in the manner described above, bottom rail tubes 128 and 133, and 130 and 135, are held in rigid planar relationship with first and second frame halves 124 and 126, and in the position shown in FIG. 4. There is a lack of hinging action of first and second hinges 132 and 134 about the axes that are along lines 144—144, 145—145 and 146—146, 147—147 (FIG. 4), respectively, and there is a resistance to hinging of hinges 132 and 134 about the axes that are along lines 140—140, 141—141, and 142—142, 143—143 (FIG. 4), due to the rigidity provided by first and second frame halves 124 and 126 of frame 123 and the impedance to rotation provided by retaining bar 202, as discussed above (FIGS. 7 and 8). Because first and second hinges 132 and 134 are not hingingly operable about the axes which are lines 144—144 145—145, and 146-146, 147—147, respectively, when oriented as shown in FIG. 4, first and second hinges 132 and 134 are operable to provide structural rigidity about these axes, holding first and second frame halves 124 and 126 in inflexible planar alignment, and defining in that orientation the frame inflexible position.

Continuing to refer to FIG. 4, the leg means of the most preferred embodiment of the present invention include a first pair of legs 148 and 150 that are downwardly disposed distal extensions of bottom rail tubes 133 and 128, respectively, which extensions turn downwardly from bottom rail tubes 133 and 128 at points along the axes of rotation thereof that are outside the perimeter formed by first and second frame halves 123 and 124 of frame 123. The leg means of the most preferred embodiment also includes a second pair of legs 152 and 154 that are downwardly disposed distal extensions of bottom rail tubes 135 and 130, respectively, which extensions turn downwardly from bottom rail tubes 135 and 130 at points along the axes of rotation thereof that are outside the perimeter formed by first and second frame halves 123 and 124 of frame 123.

Figure 11:
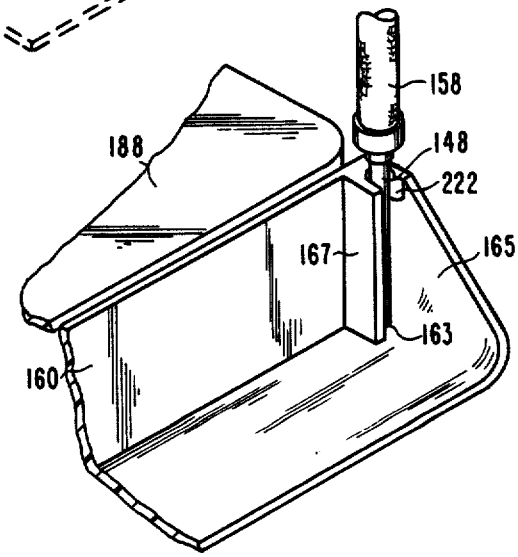
FIG. 11 is an enlarged segmented view of rigid floor means 188 with rigid floor support 160 of FIG. 1 with the distal end of leg 148 of the most preferred embodiment of the present invention in snapping engagement therewith.

Referring to FIGS. 4, 10, and 11, the distal ends of legs 148, 150, 152, and 154 are provided with identically sized caps 156, and with padding 158 to surround each leg 148, 150, 152, and 154.

Figure 2:
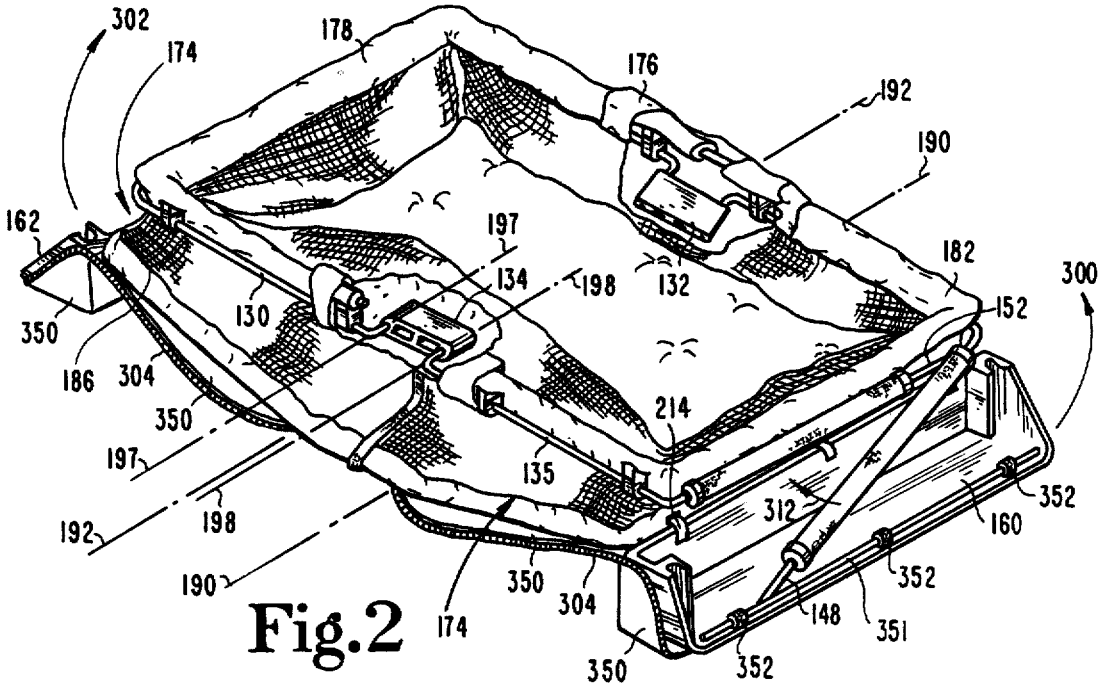
FIG. 2 is a perspective and partially segmented view of the portable collapsible baby crib of FIG. 1 with the crib structure partially collapsed and the support structure partially collapsed.

Referring now to FIGS. 1, 2 and 4, support structure 122 (FIG. 4) of the most preferred embodiment also supports a collapsible crib structure 174 shown in FIG. 1 mounted to and supported about the perimeter of first and second frame halves 124 and 126 of frame 123. As shown in FIG. 1, first and second frame halves 124 and 126 are completely surrounded by padding 182 and 178, which padding can be conventional cloth covered foam padding as in the preferred embodiment, discussed above, and bottom rail tubes 128, 130, 133, and 135 remain substantially free of padding. Referring to FIG. 1, padding 176 and 180 substantially surrounds first and second hinges 132 and 134, extending freely over the upper-most surfaces of padding 178 and 182, and extending downwardly over the outward-most and inner-most surfaces of first and second top hinges 132 and 134. So disposed, padding 176 and 180 (FIGS. 1 and 2) are rotatable with bottom rail tubes 128, 130, 133, and 135, as will be described below. Padding 176 and 180 will therefore substantially surround first and second hinges 132 and 134 when in the frame inflexible position (FIGS. 1 and 4), and will rotate with first and second hinges 132 and 134 into a position that will not inhibit a full collapsing of the first and second hinges 132 and 134 about the axes that are lines 197–198 (FIGS. 2 and 5) when in the frame collapsible position.

The collapsible crib structure of the most preferred embodiment further includes conventional webbed wall structure 186 appended from the bottom-most edges of padding 178 and 182 as in the preferred embodiment, joining said padding together around the bottom-most edges thereof. Webbed wall structure 186 is in turn attached to or receives the rigid floor means of the most preferred embodiment. Referring to FIGS. 1–6, the rigid floor means of the present invention includes a rigid floor member 188 hinged by conventional means, such as with conventional continuous piano-type hinges, or even with tape, along lines 190—190 and 192—192 (FIGS. 1, 2, and 6). Rigid floor member 188 is suspendingly attached about its perimeter to webbed wall structure 186. Such attachment can be accomplished by any number of conventional means utilized to attach fabric-like structure to a rigid surface. Alternatively, rigid floor member 188 may be freely supported by webbed wall structure 186 by extending the webbed wall structure completely about and under rigid floor member 188 such that rigid floor member 188 is cradled by webbed wall structure 186.

Rigid floor member 188 is also hingingly attached to rigid floor supports 160 and 162 by contentional means. In the most preferred embodiment, such attachment is accomplished by fabric hinges 214 (FIG. 6), sewn directly onto or through rigid floor member 188. Alternatively, rigid floor supports 160 and 162 may be hingingly attached to the webbed wall structure 186 in the embodiment in which the webbed wall structure completely surrounds and cradles rigid floor member 188 by sewing fabric hinges 124 directly onto webbed wall structure 186.

Referring to FIGS. 4 and 10 and 11, rigid floor supports 160 and 162 of the most preferred embodiment are operable to pivotally receive the distal end portions of legs 148 (FIGS. 10 and 11) and 150; and 152 and 154, respectively, into snapping arrest, thereby providing stability for support structure 122 when in the frame inflexible position (FIG. 4). In the most preferred embodiment, rigid floor supports 160 and 162 are generally L-shaped members having closed end positions, with each end portion provided with semi-circular channels 220 into which legs 148 (FIGS. 10 and 11), 150, 152, and 154 are snappingly received and arrested through the locking engagement of support tongues 222 upon the distal endportions of legs 148 (FIGS. 10 and 11), 150, 152, and 154.

At the base of each channel 220 is a through-hole 163 sized to snugly receive caps 156 located at the distal ends of legs 148 (FIGS. 10 and 11), 150, 152, and 154. Referring to FIGS. 10 and 11, each channel 220 is disposed directly above a through-hole 156 and is defined by the closed end portion 165 of rigid floor supports 160 and 162, a side wall 167, and a support tongue 222. When legs 148, 150, 152, and 154 are rotated into the frame inflexible position (FIG. 4), caps 156 at the distal ends of each leg are received into through-holes 156 when rigid floor supports 160 and 162 each positioned as shown in FIG. 10 (rigid floor support 160). Referring to FIG. 10, each rigid floor support is then further rotatable generally in the direction of the arrows in FIG. 10 allowing the assembler of the portable collapsible baby crib of the most preferred embodiment to utilize each rigid floor support as a mechanically-advantaged lever arm about the pivot point that is through-hole 163, thereby assisting the assembler in snappingly arresting the distal end portions of legs 148 (FIG. 11), 150, 152, and 154 into channels 220 and the locking engagement of support tongues 222 (FIG. 11). In the reverse sequence, the disassembler may utilize such mechanical advantage about the pivot point that is through-hole 163 described above to obtain a mechanical advantage to disengage the distal end portions of legs 148 (FIG. 11), 150, 152, and 154 from the locking engagement of support tongues 222 (FIG. 10), by pivoting the rigid floor supports from the position depicted in FIG. 11 to that depicted in FIG. 10.

Rigid floor supports 160 and 162 of the most preferred embodiment of the present invention are constructed by conventional methods from molded plastic with channels 220 of appropriate dimensions to snappingly receive and arrest the distal ends of legs 148 FIGS. 10 and 11) and 152, and 150 and 154, respectively, in the frame inflexible position.

When support structure 122 is in the frame inflexible position (FIGS. 1 and 4), rigid floor member 188 is supported by rigid floor supports 160 and 162 by the action of fabric hinges 214, and by the upward tensional forces of the taut webbed wall structure 186.

Figure 5:
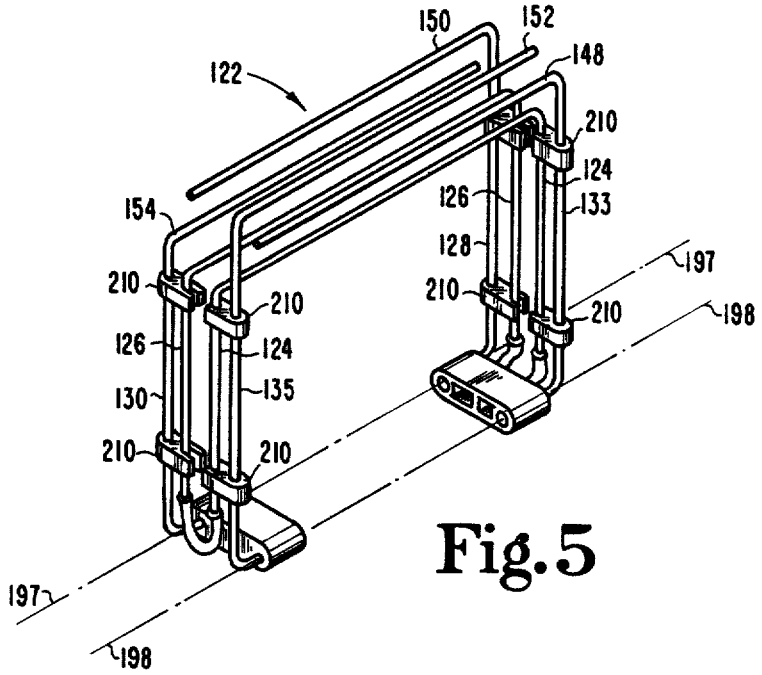
FIG. 5 is a perspective view of the support structure of the portable collapsible baby crib of FIG. 1, shown without the collapsible crib structure of the present invention, fully collapsed with the rotatable hinging means of the present invention in the frame collapsing position.
Figure 6:
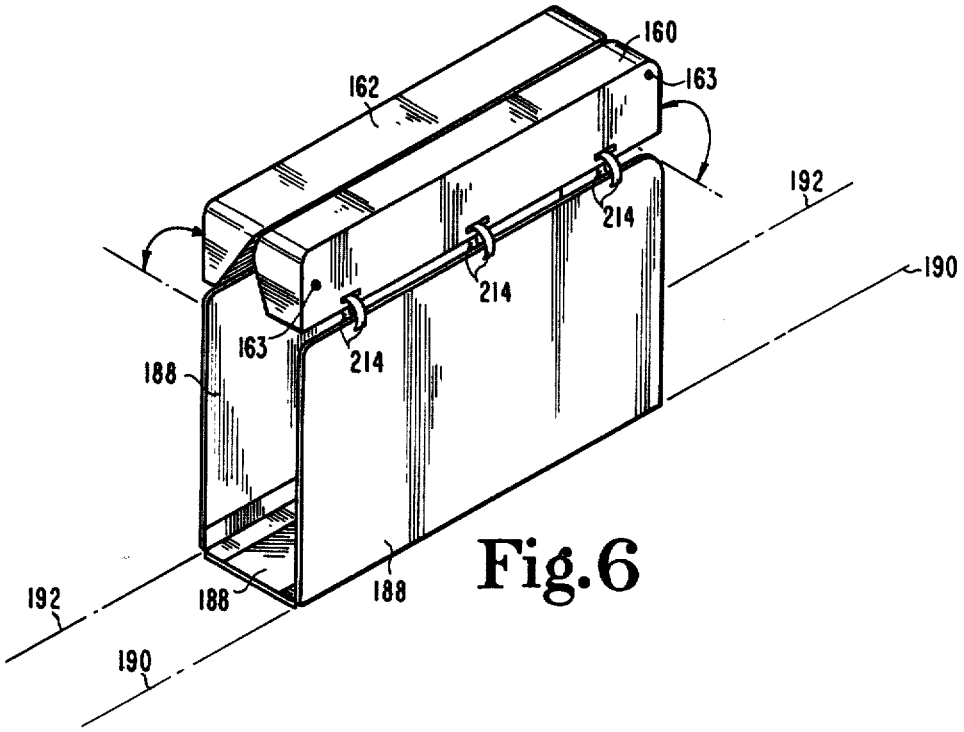
FIG. 6 is a perspective view of the rigid floor means with rigid floor supports of the collapsible crib structure of FIG. 1, in the fully closed position of FIG. 3.

Referring to FIGS. 2, and 10 and 11, when the distal ends of legs 148 (FIGS. 10 and 11) and 152, and 150 and 154 and snappingly removed from the locking engagement of support tongues 222 within rigid floor support channels 220 when support structure 122 is in the frame inflexible position (FIG. 4), legs 148 and 152, and 150 and 154 are rotatable with bottom rail tubes 133, 135, 128, and 130, respectively, with first and second hinges 132 and 134, and with the surrounding padding 176 and 180 inwardly through approximately 90° (Arrow 312, FIG. 2), until legs 148 and 152 (FIG. 2), and 150 and 154 are received within the area generally bounded by rigid floor supports 160 and 162, respectively, and are in planar relationship with first and second frame halves 124 and 126, (leg 152 in FIG. 2, see also FIG. 5). Rigid floor supports 160 and 162 are then pivoted about cloth hinges 214 (FIG. 6) through approximately 90° in the direction of the arrows 300 and 302 (FIGS. 2 and 6). Such configuration then defines the frame collapsible position. Legs 148 and 150, and legs 152 and 154 are located precisely at the distal ends of bottom rails 133 and 128, and 135 and 130, respectively, such that when legs 148 and 152 and 150 and 154 are rotated into the area generally bounded by rigid floor supports 160 and 162, legs 148 and 152, and 150 and 154 are in a side-by-side relationship, and not a stacked relationship (FIG. 5).

When the legs 148 and 152, and 150 and 154, and rigid floor supports 160 and 162 are so rotated, first and second frame halves 124 and 126 and bottom rail tubes 133, 128, 135, and 130 are simultaneously collapsed downwardly onto rigid bottom member 188, carrying therewith the webbed wall structure 186, all of which is collapsed within the area bounded by the perimeter of the rigid bottom member 188 and rigid floor supports 160 and 162 (FIG. 2).

Figure 3:
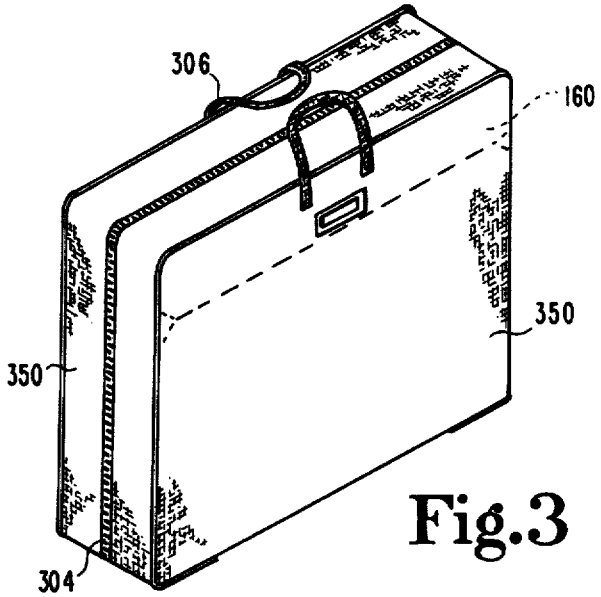
FIG. 3 is a perspective view of the portable collapsible baby crib of FIG. 1 with the valise structure fully closed.

Referring to FIGS. 2, 5 and 6, when first and second hinges 132 and 134 are rotated as described above, first and second hinges 132 and 134 are oriented and disposed such that first and second hinges become hingingly operable about the axis that are lines 197—197 and 198—198 (FIGS. 2 and 5). In such orientation, rigid floor member 188 is hingingly operable along lines 190—190 and 192—192 (FIG. 6) in sympathy with first and second hinges 132 and 134, thereby permitting support structure 122, collapsible crib structure 174, rigid floor member 188 and rigid floor supports 160 and 162 to fold together in the direction of the arrows 300 and 302 in FIG. 2. Referring to FIG. 5, there is shown support structure 122, without the collapsible crib structure 174, without rigid floor member 122, and without rigid floor supports 160 and 162, folded together in the manner described. When collapsible support structure 122 and collapsible crib structure 174 and rigid floor supports 160 and 162 are so folded together, rigid floor member 188 and rigid floor supports 160 and 162 form a valise structure around support structure 122 (FIG. 6) and collapsible crib structure 174 as shown in FIG. 3. A cloth or suitable fabric-like cover 350 is provided (FIG. 3) that is closeable with a conventional zipper 304 disposed about the perimeter of rigid floor member 188 and bottom support means 160 and 162 renders the structure closeable in the manner a conventional valise would be closed, as shown in FIG. 3, providing a compact carrying case completely enclosing the collapsible crib structure and thereby protecting the crib structure from wear and tear and soiling while in transit. The cloth cover 350 may be attached to rigid floor member 188, or webbed wall structure 186, or as shown in FIG. 2, it may be attached to rigid floor supports 160 (FIG. 2) and 162 by dowel rods 351 and fabric tabs 352 that are secured around dowel rods 351 and pass through rigid floor supports 160 and 162 and are conventionally fastened to cover 250. Handles 306 are provided for valise-like carrying capability.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A portable collapsible crib, comprising:

a rigid frame that is separable generally at the midpoints of a pair of opposing sides thereof into a first frame half and a second frame half;

rotatable hinging means, coupling said first and second frame halves at said midpoints, hingingly operable about first axes for foldably collapsing said first and second frame halves one upon the other about said midpoints, defining a frame collapsing position, and rotatably operable about second axes that are perpendicular to said first axes for rigidly supporting said first and second frame halves in inflexible planar alignment, defining a frame inflexible position;

leg means, mounted to said frame and rotatable concurrently with said rotatable hinging means, for elevating said frame to a predetermined height when rotated downwardly from said frame, said rotatable hinging means being concurrently rotated into said frame inflexible position, said leg means being further rotatable into parallel planar alignment with said first and second frame halves, said rotatable hinging means being concurrently rotated into said frame collapsing position; and a collapsible crib structure mounted to and supported about the perimeter of said frame and disposed downwardly therefrom, having rigid floor means with rigid floor supports removably attachable to said leg means at predetermined points below said rigid frame when said leg means are disposed downwardly from said frame, said floor meanings being operable to receive said rigid frame, said leg means, and said collapsible crib structure within the area bounded by the perimeter of said floor means when said leg means are rotated into parallel planar alignment with the said first and second frame halves, said rotatable hinge means being concurrently rotated into said frame collapsing position, said rigid floor means being further operable to fold about and enclose said first and second frame halves and said collapsible crib structure in said frame collapsing position, forming a valise structure thereabout.

2. The portable collapsible crib of claim 1, wherein said rigid frame is rectangular in configuration.

3. The portable collapsible crib of claim 2, wherein said first frame half includes a rigid first U-member and said second frame half includes a rigid second U-member, said first and second U-members being of equal corresponding dimensions.

4. The portable collapsible crib of claim 3, wherein said first U-member includes a first U-tube and said second U-member includes a second U-tube.

5. The portable collapsible crib of claim 4, wherein said rotatable hinging means includes a rigid first bottom rail tube and a rigid third bottom rail tube separably hinged at the proximal end points thereof by a first hinge, and disposed in parallel relationship below one of said opposing sides of said frame such that said first hinge and said midpoints of said opposing side of said frame are in juxtaposition, and a second bottom rail tube and a fourth bottom rail tube separably hinged at the proximal end points thereof by a second hinge, and disposed in parallel relationship below the other of said opposing sides of said frame such that said second hinge and said midpoints of the other of said opposing sides of said frame are in juxtaposition, said bottom rail tubes remaining rotatable about their centerlines, being thereby operable to rotate said first and second hinges about said midpoints of said opposing sides of said frame between said frame collapsing and said frame inflexible positions.

6. The portable collapsible crib of claim 5, wherein said first and second hinges are operable about said first axes to fold said first and second frame halves between said frame collapsing and said frame inflexible positions only.

7. The portable collapsible crib of claim 5, wherein said leg means includes a first pair of legs attached to the distal ends of said first and third bottom rail tubes and disposed in planar relationship with said first hinge, and a second pair of legs attached to the distal ends of said second and fourth bottom rail tubes and disposed in planar relationship with said second hinge.

8. The portable collapsible crib of claim 7, wherein said rigid floor supports include a pair of generally L-shaped members having closed end portions provided with channels operable to snappingly receive and arrest the distal end portions of oppositely opposed legs of said first and second pair of legs when in said frame inflexible position.

9. The portable collapsible crib of claim 8, wherein said rigid floor supports are pivotally mounted to said collapsible crib structure.

10. The portable collapsible crib of claim 9, wherein said channels are disposed directly above through-holes in said rigid floor supports to receive the distal ends of said legs when in said frame inflexible position, and which are operable to provide a pivot point about which said rigid floor supports are pivotable when snappingly arresting and releasing the distal end portions of said legs.

11. The collapsible crib of claim 1 wherein:

said valise structure includes zipper means fixably attached to the perimeter of said rigid floor means for securely enclosing said solid frame, said leg means and said collapsible crib structure in said frame collapsing position.

12. The collapsible crib of claim 1 wherein said collapsible crib structure includes padding means fixably attached to said rotatable hinging means and rotatable therewith between said frame collapsing and frame inflexible positions and operable thereby to substantially surround said rotatable hinging means with said padding means when said rotatable hinging means is rotated to said frame inflexible position.

13. A portable collapsible frame for supporting a collapsible crib structure, comprising:

a rigid frame that is separable generally at the midpoints of a pair of opposing sides thereof into a first frame half and a second frame half;

rotatable hinging means, coupling said first and second frame halves at said midpoints, hingingly operable about first axes for foldably collapsing said first and second frame halves one upon the other about said midpoints, defining a frame collapsing position, and rotatably operable about second axes that are perpendicular to said first axes for rigidly supporting said first and second frame halves in inflexible planar alignment, defining a frame inflexible position; and legs means, mounted to said frame and rotatable concurrently with said rotatable hinging means, for elevating said frame to a predetermined height when rotated downwardly from said frame, said rotatable hinging means being concurrently rotated into said frame inflexible position, said leg means being further rotatable into planar alignment with said first and second frame halves, said rotatable hinging means being concurrently rotated into said frame collapsing position.

14. A portable collapsible frame for supporting a collapsible crib structure, comprising:

a rigid frame that is separable generally at the midpoints of a pair of opposing sides thereof into a first frame half and a second frame half; and rotatable hinging means, coupling said first and second frame halves at said midpoints, hingingly operable about first axes for foldably collapsing said first and second frame halves one upon the other about said midpoints, defining a frame collapsing position, and rotatably operable about second axes that are perpendicular to said first axes for rigidly supporting said first and second frame halves in inflexible planar alignment, defining a frame inflexible position.

15. A hinge for coupling a rigid frame that is separable into first and second frame halves, comprising:

rotatable hinging means coupling said first and second frame halves, hingingly operable about first axes for foldably collapsing the first and second frame halves one upon the other, defining a frame collapsing position, and rotatably operable about second axes that are perpendicular to said first axes for rigidly supporting said first and second frame halves in inflexible alignment, defining a frame inflexible position.

16. The hinge of claim 15, and further comprising:

means for limiting the rotation of said hinging means affixed to said hinging means and operable to limit the hinging operability thereof between said frame collapsing and said frame inflexible positions.

* * * * *

UNITED STATES PATENT AND TRADEMARK OFFICE

CERTIFICATE OF CORRECTION

PATENT NO. : 4,819,285

DATED : April 11, 1989

INVENTOR(S) : G. David Fetters

It is certified that error appears in the above-identified patent and that said Letters Patent is hereby corrected as shown below:

Title page, under the attorney, agent, or firm designation, change "Nauthton" to --Naughton--;

column 5, line 60, change "124" to --123--;

column 6, line 7, change "124" to --123--;

column 6, line 41, change "127" to --128--;

column 10, line 3, change "250" to --350--.

Signed and Sealed this

Twenty-eighth Day of November 1989

*Attest:*

JEFFREY M. SAMUELS

*Attesting Officer* *Acting Commissioner of Patents and Trademarks*